US009703251B1

(12) United States Patent
Yoshioka

(10) Patent No.: US 9,703,251 B1
(45) Date of Patent: Jul. 11, 2017

(54) IMAGE FORMING ASSEMBLY AND IMAGE FORMING APPARATUS

(71) Applicant: FUJI XEROX CO., LTD., Tokyo (JP)

(72) Inventor: Sakae Yoshioka, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/242,867

(22) Filed: Aug. 22, 2016

(30) Foreign Application Priority Data

Feb. 26, 2016 (JP) ..... 2016-035399

(51) Int. Cl.
*G03G 15/00* (2006.01)

(52) U.S. Cl.
CPC ..... *G03G 15/757* (2013.01)

(58) Field of Classification Search
USPC ..... 399/107, 110, 113, 116, 117, 159, 167
See application file for complete search history.

(56) References Cited

U.S. PATENT DOCUMENTS 6,980,759 B2 * 12/2005 Kanno ..... G03G 21/1825 399/111
7,509,071 B2 * 3/2009 Yoshimura ..... G03G 21/1825 399/110
7,925,181 B2 * 4/2011 Hattori ..... G03G 21/1842 399/111
8,068,767 B2 * 11/2011 Kamimura ..... G03G 21/1864 399/167
8,583,005 B2 * 11/2013 Asanuma ..... G03G 21/1825 399/111

FOREIGN PATENT DOCUMENTS

JP 2004-271815 A 9/2004

* cited by examiner

*Primary Examiner* — Hoan Tran
(74) *Attorney, Agent, or Firm* — Oliff PLC

(57) ABSTRACT

An image forming assembly including a first assembly that includes an image holding member which rotates by receiving a rotational driving force and holds a toner image after an electrostatic latent image is formed thereon by exposure and the toner image is formed by development and a supporting member which supports the image holding member, a second assembly that includes a developing member which is disposed adjacent to the image holding member, rotates by receiving a rotational driving force, and transports a toner to a developing region facing the image holding member and a toner holding member which holds the toner and supplies the toner to the developing member, and a connection member that includes a pressing member in which a first through hole and a second through hole are formed and that is fixed to the supporting member.

4 Claims, 6 Drawing Sheets

IMAGE FORMING ASSEMBLY AND IMAGE FORMING APPARATUS

CROSS-REFERENCE TO RELATED APPLICATIONS

This application is based on and claims priority under 35 USC 119 from Japanese Patent Application No. 2016-035399 filed Feb. 26, 2016.

BACKGROUND

Technical Field

The present invention relates to an image forming assembly and an image forming apparatus.

SUMMARY

According to an aspect of the invention, there is provided an image forming assembly including:

a first assembly that includes an image holding member which rotates by receiving a rotational driving force to a first rotation shaft extending in a first direction and holds a toner image after an electrostatic latent image is formed thereon by exposure and the toner image is formed by development and a supporting member which supports the image holding member;

a second assembly that includes a developing member which is disposed adjacent to the image holding member, rotates by receiving a rotational driving force to a second rotation shaft extending in the same direction as the first direction, and transports a toner to a developing region facing the image holding member and a toner holding member which holds the toner and supplies the toner to the developing member; and a connection member that includes a pressing member in which a first through hole which the first rotation shaft penetrates and a second through hole which the second rotation shaft penetrates are formed and which presses the second rotation shaft in a second direction intersecting the first direction and that is fixed to the supporting member.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described.

Figure 1:
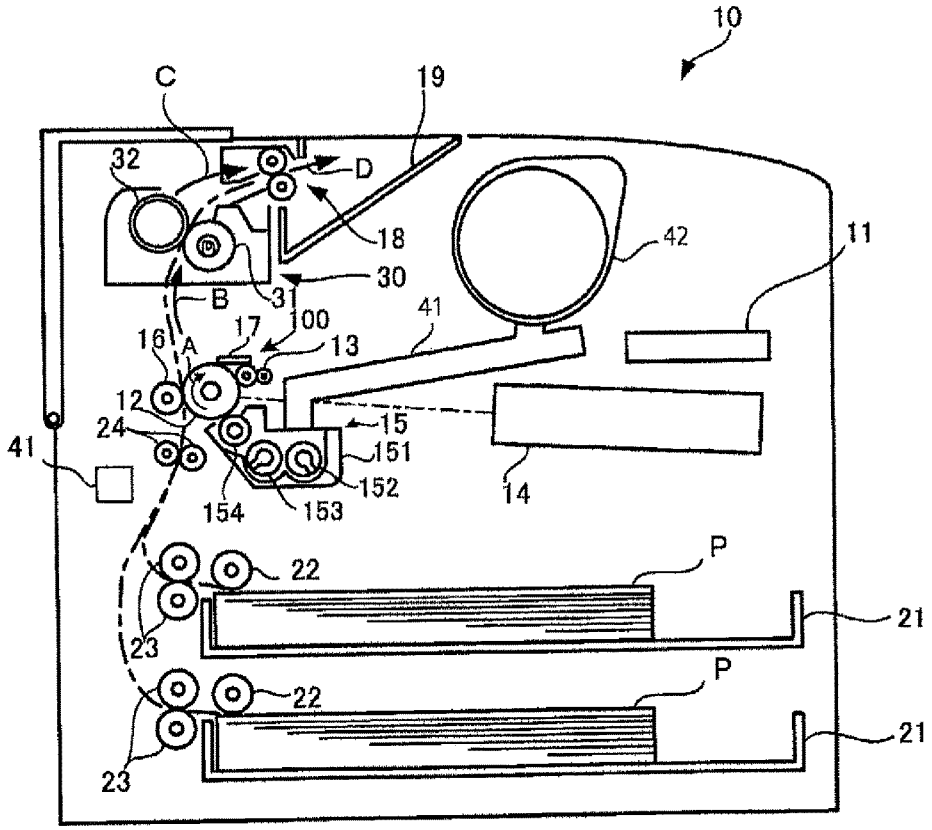
FIG. 1 is a schematic configuration diagram of a printer as an exemplary embodiment of an image forming apparatus of the invention.

FIG. 1 is a schematic configuration diagram of a printer as an exemplary embodiment of an image forming apparatus of the invention.

A printer 10 shown in FIG. 1 is a monochrome printer, and the exemplary embodiment of an image forming assembly of the invention is incorporated in the printer 10.

An image signal representing an image that is created in a different device from the printer 10 is input via a signal cable (not shown) into the printer 10. The printer 10 is provided with a controller 11 that controls operation of each configuration element in the printer 10 and the image signal is input to the controller 11. Image formation is performed based on the image signal under control according to the controller 11 in the printer 10.

Two sheet trays 21 are accommodated at the lower side of the printer 10. Sheets P of a different size and thickness for each sheet tray 21 in these sheet trays 21 are accommodated in a state of being piled respectively. Each sheet tray 21 is configured to be freely pulled out for replenishment of the sheets P.

The paper P is fed by a pickup roller 22 from the sheet tray accommodating the designated sheet P of the two sheet trays 21. The fed sheets P are separated one by one by a separation roller 23. The separated one sheet of the sheets P is transported upward, and a leading edge of the sheet P reaches a standby roller 24. The standby roller 24 plays a role of adjusting a timing of subsequent transportation and feeding the sheet P. The sheet P which reaches at the standby roller 24 is further transported by the timing of subsequent transportation being adjusted by the standby roller 24.

The printer 10 is provided with a photoconductor drum 12 rotating in a direction indicated by an arrow A on the upper side of the standby roller 24. A charging unit 13, an exposure device 14, a developing device 15, a transfer unit 16 and a photoconductor cleaner 17 are disposed around the photoconductor drum 12. The photoconductor drum 12, the charging unit 13 and the photoconductor cleaner 17 are integrally assembled among these devices to constitute a photoconductor unit 100. In the same way as this, the developing device 15 is also unitized. The photoconductor unit 100 and the developing device 15 are integrally connected by an input shaft side connection member 50 and a non-input shaft side connection member 60 (refer to FIG. 3) which will be described later. The photoconductor unit 100 and the developing device 15 correspond to each example of a first assembly and a second assembly respectively according to the exemplary embodiment of the invention. A configuration that combines the photoconductor unit, the developing device 15 and further a connection member which will be described later corresponds to an example of the image forming assembly according to the exemplary embodiment of the invention.

Figure 2:
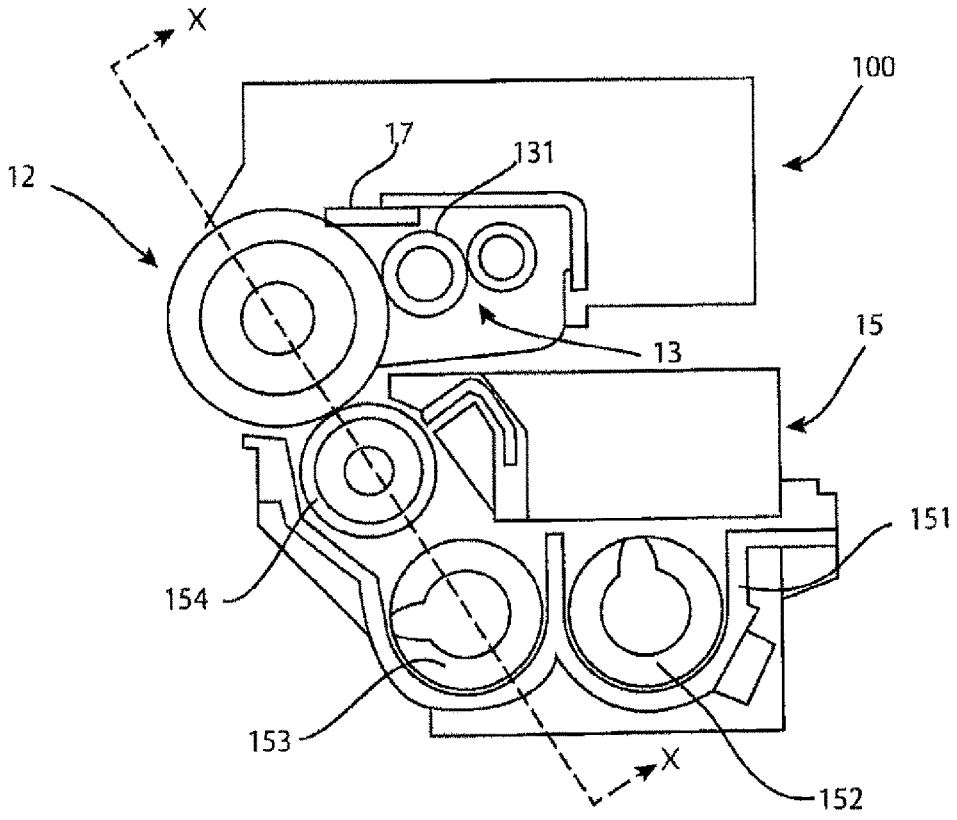
FIG. 2 is a cross-sectional view according to a plane perpendicular to a rotation shaft of a photoconductor unit and a developing device.

FIG. 2 is a cross-sectional view according to a plane perpendicular to a rotation shaft of a photoconductor unit and a developing device. Hereinafter, with reference to FIG. 1 and FIG. 2, the description for the printer 10 will be continued.

The photoconductor drum 12 includes a cylindrical shape and extends in the depth direction of FIG. 1 and FIG. 2. The photoconductor drum 12 holds an electric charge by charging and releases the electric charge by exposure to form an electrostatic latent image on a surface.

The charging unit 13 is provided with a charging roller 131 rotating in contact with the surface of the photoconductor drum 12, and charges the surface by applying the electric charge to the surface of the photoconductor drum 12 by the charging roller 131. As the charging unit 13, in addition to the charging roller 131, a non-contact corona discharger with a photoconductor may also be adopted.

The exposure device 14 (refer to FIG. 1) includes an emission device for emitting a modulated laser beam (exposure light) in accordance with the image signal supplied from the controller 11 and a rotating polygonal mirror for scanning the photoconductor drum 12 with the laser beam. Exposure light is emitted from the exposure device 14. The photoconductor drum 12 receives the exposure by the exposure light to form the electrostatic latent image on the surface. As the exposure device 14, in addition to a method using the laser beam, an LED array in which a large number of LEDs is arranged along a scanning direction may be adopted. Furthermore, as a method forming the latent image, in addition to an exposure method, a method of directly forming the latent image with a large number of electrodes arranged along the scanning direction may be adopted.

The photoconductor drum 12 is exposed by the exposure light and the electrostatic latent image formed on the surface thereof is developed by the developing device 15. A replenishing toner accommodating unit 42 is connected to the developing device 15 via a toner supply path 41, as shown in FIG. 1. A developer including a toner and a magnetic carrier is stored in an accommodating unit 151 constituting the developing device 15. The toner stored in the replenishing toner accommodating unit 42 is appropriately replenished into the accommodating unit 151 of the developing device 15 via the toner supply path 41. The magnetic carrier, for example, is obtained by applying a resin coating on the surface of iron powder. Toner particles, for example, are formed with a binder resin, colorant and a releasing agent as the material. Two augers 152 and 153 extending in a depth direction of FIG. 1 and FIG. 2 in the accommodating unit 151 are disposed in the developing device 15. The developer in which the magnetic carrier and the toner are mixed by the rotation of two augers 152 and 153 is stirred while being circulated and moved in a direction perpendicular to the sheet surface of FIG. 1 and FIG. 2. In this manner, the toner and the magnetic carrier are charged. The developing device 15 is further provided with a developing roller 154. The developer in the accommodating unit 151 is supplied to the photoconductor drum 12 by the developing roller 154, and the electrostatic latent image on the photoconductor drum 12 is developed by a charging toner in the developer. In this manner, the toner image is formed on the photoconductor drum 12. Here, the photoconductor drum 12 corresponds to an example of an image holding member according to the exemplary embodiment of the invention. The developing roller 154 corresponds to an example of a developing member according to the exemplary embodiment of the invention.

The above-described standby roller 24 feeds the sheet P so that the sheet P reaches a transfer position in accordance with the timing at which the toner image on the photoconductor drum 12 reaches the transfer position facing the transfer unit 16. The toner image on the photoconductor drum 12 is transferred on the sheet P which is fed out thereof by receiving the action of a transfer bias applied to the transfer unit 16.

The toner remaining on the photoconductor drum 12 after the transfer of the toner image is removed from the photoconductor drum 12 by the photoconductor cleaner 17.

The sheet P which received the transfer of the toner image moves further in the direction of the arrow B, and receives heat and pressure when passing through a fixing position sandwiched between a heater 31 and a pressurizer 32 constituting the fixing machine 30. In this manner, the toner image is fixed onto the sheet P. As a result, the image which includes the fixed toner image is formed on the sheet P.

The sheet P which has passed the fixing machine 30 moves in the direction of the arrow C toward an exit roller 18 and is further transported in the direction of the arrow D by the exit roller 18 to be ejected on a paper ejection tray 19.

Figure 3:
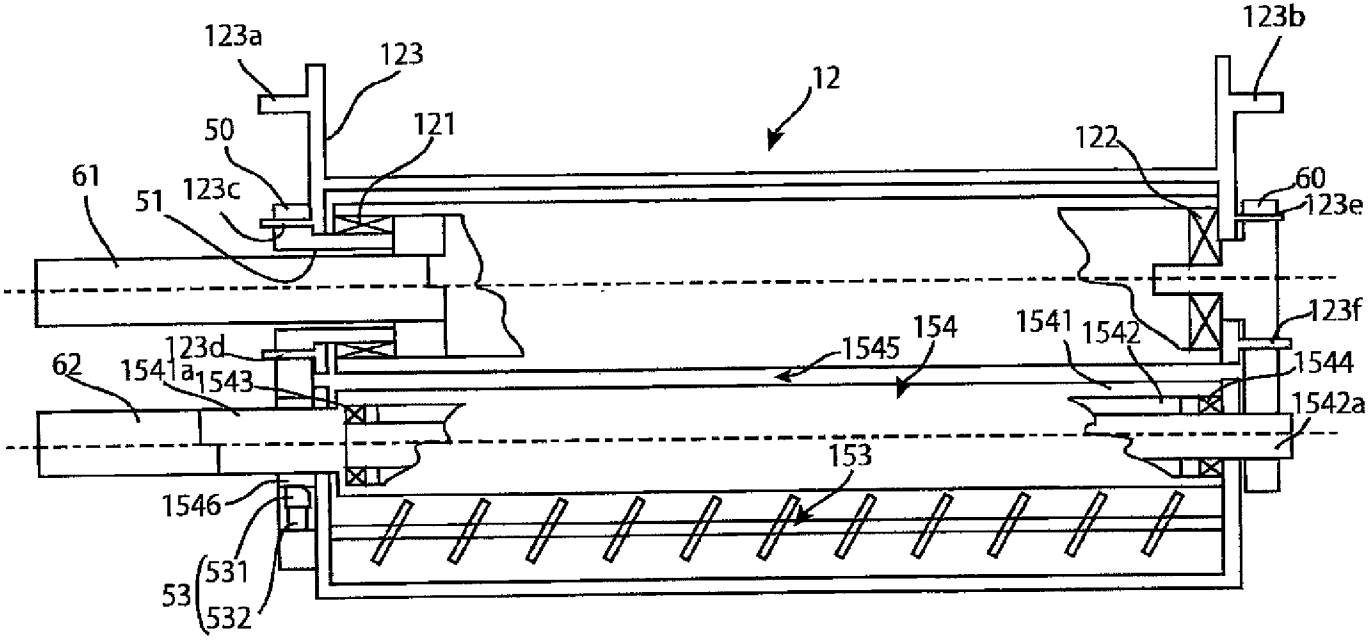
FIG. 3 is a sectional view of the photoconductor unit and the developing device according to a plane extending along line X-X shown in FIG. 2.

FIG. 3 is a sectional view of the photoconductor unit and the developing device according to a plane extending along line X-X shown in FIG. 2.

Both end portions of the photoconductor drum 12 in the longitudinal direction are supported by the input shaft side connection member 50 and the non-input shaft side connection member 60 via bearings 121 and 122. The input shaft side connection member 50 is fixed to a supporting member 123 positioned by positioning pins 123*c* and 123*d*, and the non-input shaft side connection member 60 is fixed to the supporting member 123 positioned by the positioning pins 123*e* and 123*f*. The input shaft side connection member 50 among the input shaft side connection member 50 and the non-input shaft side connection member 60 corresponds to an example of the connection member according to the exemplary embodiment of the invention. A through hole 51 that the rotation shaft 61 which is driven to rotate the photoconductor drum 12 penetrates is formed in the input shaft side connection member 50. The rotation shaft 61 is a member extending from a main body of the printer 10 to the inside of the photoconductor drum 12, and is connected to the photoconductor drum 12 in an inner side of the photoconductor drum 12. The through hole 51 disposed in the input shaft side connection member 50 is in the hole of a larger diameter than the diameter of the rotation shaft 61, and the rotation shaft 61 penetrates the through hole 51 in a non-contact manner with a wall surface of the through hole 51.

Both end portions of the photoconductor drum 12 are rotatable with the bearings 121 and 122 and are supported by the input shaft side connection member 50 and the non-input shaft side connection member 60. The input shaft side connection member 50 and the non-input shaft side connection member 60 are fixed to the supporting member 123. An axial deflection by the rotary drive is sufficiently suppressed to be small for both an input shaft side and a non-input shaft side in the photoconductor drum 12 by this configuration.

The developing roller 154 as shown in FIG. 3 includes the configuration in which a magnet structure 1542 is disposed in a developing sleeve 1541 having a cylindrical shape. The developing sleeve 1541 and the magnet structure 1542 are connected to each other via the bearings 1543 and 1544 disposed at both end portions thereof. The magnet structure 1542 includes a fixing shaft 1542*a* extending to the non-input shaft side, and the fixing shaft 1542*a* is non-rotatably fixed to the non-input shaft side connection member 60.

The rotation shaft 1541*a* extending from the developing sleeve 1541 is stretched on the input shaft side. The rotation shaft 1541*a* penetrates the other through hole 52 disposed on the input shaft side connection member 50, and is connected to a driving shaft 62 which is driven to rotate the developing roller 154 on the outer side of the accommodating unit 151 (refer to FIG. 1 and FIG. 2) of the developing device 15. That is, the developing roller 154 which is still non-rotatably fixed to the magnet structure 1542 causes the developing sleeve 1541 to be driven to rotate.

Here, both end portions of the developing sleeve 1541 are supported by the magnet structure 1542 via the bearings 1543 and 1544. Since the non-input shaft side of the magnet structure 1542 is fixed to the non-input shaft side connection member 60, the non-input shaft side is a structure strong against vibration. Additionally, although the developing sleeve 1541 and the magnet structure 1542 are supported by each other via the bearing 1543 on the input shaft side, when the vibration from the driving shaft 62 side is transmitted, the developing sleeve 1541 and the magnet structure 1542 are integrally vibrated. The developer pulled by magnetic force of the magnet structure 1542 is attached to the developing sleeve 1541. The attached developer is transported to a developing region 1545 which is facing the photoconductor drum 12, by the rotation of the developing sleeve 1541. The electrostatic latent image formed in the photoconductor drum 12 is developed by the toner in the developer in the developing region 1545. For this reason, it is effective for the image-forming of good image quality to maintain a gap between the photoconductor drum 12 and the developing sleeve 1541 in the developing region 1545 to be constant.

In the exemplary embodiment, the gap between the photoconductor drum 12 and the developing sleeve 1541 in the developing region 1545 is maintained to be constant by devising the input shaft side connection member 50.

Figure 4:
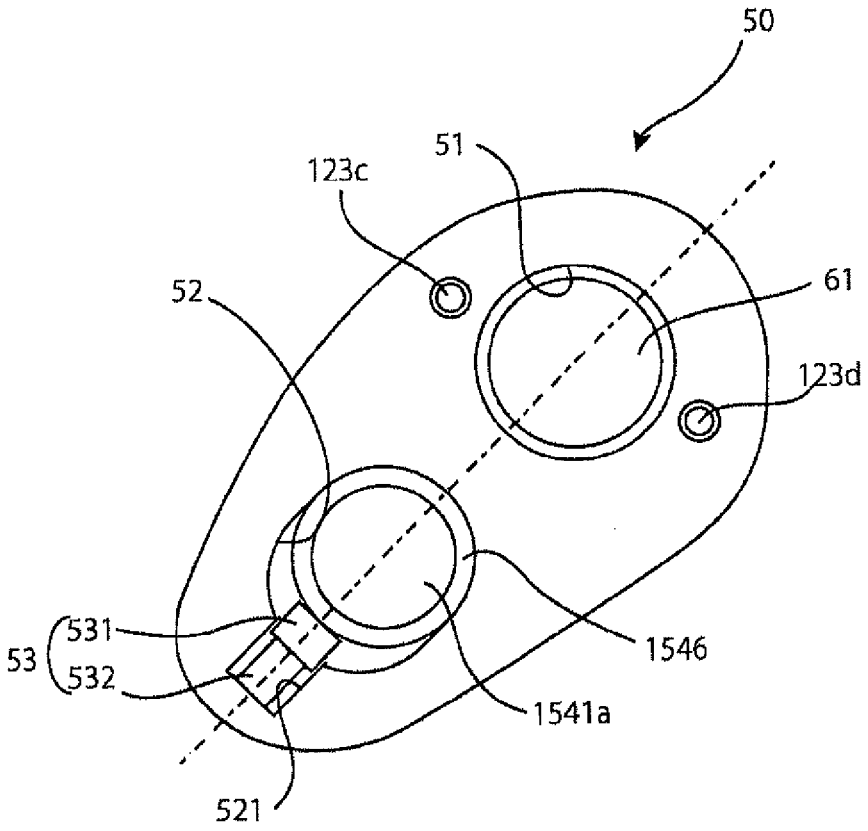
FIG. 4 is a side view of an input shaft side connection member as viewed from the left side of FIG. 3.

FIG. 4 is a side view of an input shaft side connection member as viewed from the left side of FIG. 3.

Hereinafter, with reference to the sectional view shown in FIG. 3 and the side view of FIG. 4, the input shaft side connection member 50 will be described.

The rotation shaft 1541*a* extending from the developing sleeve 1541 is in contact with the wall surface of the through hole 52 of the input shaft side connection member 50 via a sliding bearing 1546. The through hole 52 is a long hole extending in a direction that comes in contact with and separates from the rotation shaft 61 which drives the photoconductor drum 12. In the exemplary embodiment, a attachment section 521 in which a pressing member 53 is attached is disposed at the position farthest from the rotation shaft 61 of the through hole 52 and the pressing member 53 is attached in the attachment section 521 thereof. The pressing member 53 includes a contact member 531 having the same material as the input shaft side connection member 50 which is in contact with the sliding bearing 1546, and a spring member 532 which is pressed against the contact member 531 thereof on the sliding bearing 1546. In the exemplary embodiment, the rotation shaft 1541*a* of the developing roller 154 is normally pressed in a direction to approach the rotation shaft 61 which is driven to rotate the photoconductor drum 12 by the pressing member 53. For this reason, the width of the developing region 1545, that is, the gap between the photoconductor drum 12 and the developing sleeve 1541 in the developing region 1545 is stabilized, and the image with high-quality is formed.

Figure 5:
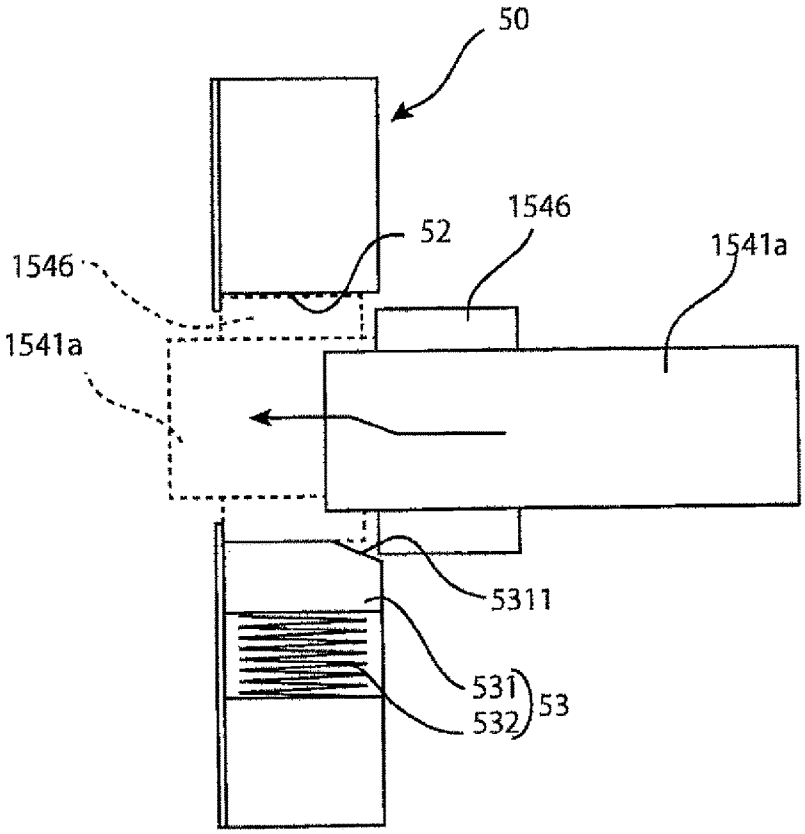
FIG. 5 is an enlarged cross-sectional view of the vicinity of a through hole of the input shaft side connection member which a rotation shaft of a developing roller penetrates.

FIG. 5 is an enlarged cross-sectional view of the vicinity of a through hole of the input shaft side connection member which the rotation shaft of a developing roller penetrates.

Here, a state is shown where the rotation shaft 1541*a* of the developing sleeve 1541 is progressively inserted into the through hole 52 of the input shaft side connection member 50.

The sliding bearing 1546 is mounted on the rotation shaft 1541*a* and the rotation shaft 1541*a* is inserted into the through hole 52 of the input shaft side connection member 50 in a state where the sliding bearing 1546 is mounted. At this time, the contact member 531 constituting the pressing member 53 is pressed by the spring member 532 to be in a state where the distance from the portion facing the pressing member 53 of the wall surface of the through hole 52 is narrower than the diameter of the sliding bearing 1546. As shown in FIG. 5, in some cases, it is inserted in a state where the through hole 52 and the rotation shaft 1541*a* are deviated. In the exemplary embodiment, an inclined surface 5311 that guides the rotation shaft 1541*a* inserted into the through hole 52 is formed in the contact member 531. The rotation shaft 1541*a* on which the sliding bearing 1546 is mounted is smoothly inserted into the through hole 52 by the inclined surface 5311 being disposed in the contact member 531.

Figure 6B:
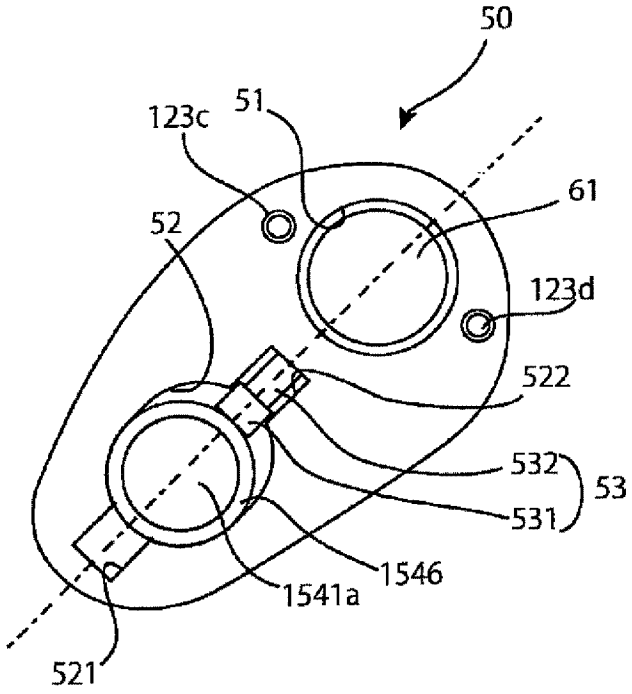
FIGS. 6A and 6B are views showing a second example of the input shaft side connection member.
Figure 6A:
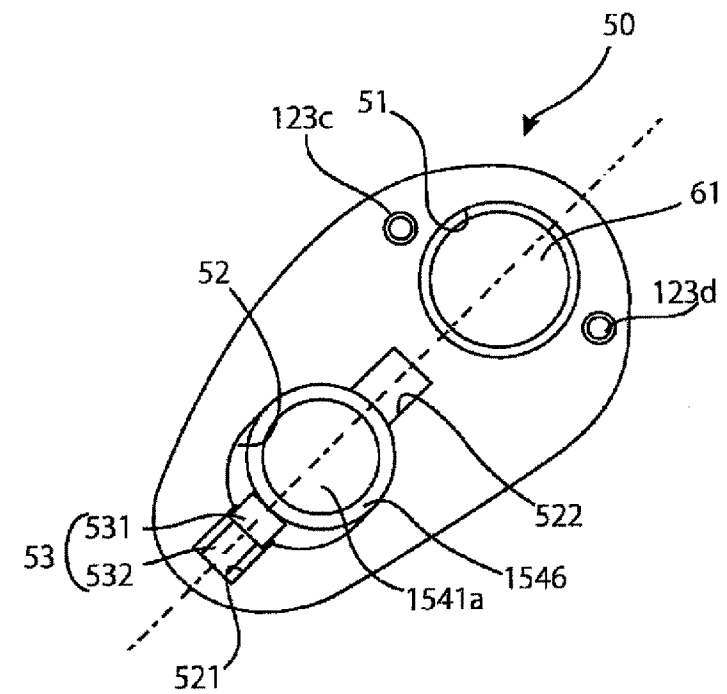

FIGS. 6A and 6B are views showing a second example of the input shaft side connection member. Here, the differences from the input shaft side connection member 50 shown in FIG. 4 will be described.

In the vicinity of the through hole 52 which the rotation shaft 1541*a* of the developing roller 154 is inserted into, of the input shaft side connection member 50 shown in FIGS. 6A and 6B, the attachment section 521 is disposed at the position farthest from the rotation shaft 61 of the photoconductor drum 12 side. Furthermore, in addition to this, another attachment section 522 is disposed at the position closest to the rotation shaft 61 of the photoconductor drum 12. FIG. 6A shows a state where the pressing member 53 is attached to the attachment section 521 disposed on the side separated from the rotation shaft 61 of the photoconductor drum 12 side of the two attachment sections 521 and 522. In this case, the rotation shaft 1541*a* causes the gap to be maintained in a state closest to the rotation shaft 61 of the photoconductor drum 12 side. On the other hand, FIG. 6B shows a state where the pressing member 53 is attached to the attachment section 522 which is the other of the two attachment sections 521 and 522. In this case, the rotation shaft 1541*a* causes the gap to be maintained in a state farthest from the rotation shaft 61 of the photoconductor drum 12 side.

As the second example shown in FIGS. 6A and 6B, if the attachment section to which the pressing member 53 is attached is disposed at plural locations around the through hole 52, the input shaft side connection member 50 may be used in common for plural models having respectively different inter-axial distances. Accordingly, it may be linked to a reduction of labor such as the reduction of the manufacturing cost or component management.

Even in a case of any of the input shaft side connection members 50 shown in FIG. 4 and FIGS. 6A and 6B, although the pressing member 53 is provided on a straight line connecting the centers of the two rotation shafts 1541*a* and 61, the direction in which the pressing member 53 presses the rotation shaft 1541*a* may intersect the rotation shaft 1541*a*. For example, the pressing member 53 may be provided at the position which horizontally presses the rotation shaft 1541*a* to the straight line connecting the centers of the two rotation shafts 1541*a* and 61.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming assembly comprising:

a first assembly that includes an image holding member which rotates by receiving a rotational driving force to a first rotation shaft extending in a first direction and holds a toner image after an electrostatic latent image is formed thereon by exposure and the toner image is formed by development and a supporting member which supports the image holding member;

a second assembly that includes a developing member which is disposed adjacent to the image holding member, rotates by receiving a rotational driving force to a second rotation shaft extending in the same direction as the first direction, and transports a toner to a developing region facing the image holding member and a toner holding member which holds the toner and supplies the toner to the developing member; and a connection member that includes a pressing member in which a first through hole which the first rotation shaft penetrates and a second through hole which the second rotation shaft penetrates are formed and which presses the second rotation shaft in a second direction intersecting the first direction and that is fixed to the supporting member.

2. The image forming assembly according to claim 1, wherein the pressing member includes an inclined surface that guides the second rotation shaft being inserted into the second through hole.

3. The image forming assembly according to claim 1, wherein the connection member includes a plurality of attachment sections to which the pressing member is attached at locations around the second through hole, and wherein the pressing member is attached to any of the plurality of the attachment sections.

4. An image forming apparatus comprising:

the image forming assembly according to claim 1;

a transfer unit that transfers a toner image formed on the image holding member to a transfer receiver; and a fixing machine that fixes the toner image on a sheet, which includes the transfer receiver itself, on the sheet or fixes the toner image on a sheet, to which the toner image is transferred from the transfer receiver, on the sheet.

* * * * *